United States Patent [19]

Yamaguchi et al.

[11] 4,301,839

[45] Nov. 24, 1981

[54] HAND WEAVING APPARATUS

[75] Inventors: Yoshimasa Yamaguchi; Akira Iino, both of Kodaira, Japan

[73] Assignee: Silver Seiko, Ltd., Kodaira, Japan

[21] Appl. No.: 48,036

[22] Filed: Jun. 13, 1979

[30] Foreign Application Priority Data

Jun. 21, 1978 [JP] Japan ..... 53/85303[U]

[51] Int. Cl.[3] ..... D03D 29/00

[52] U.S. Cl. ..... 139/29

[58] Field of Search ..... 139/29, 30, 31, 32; 66/60 H

[56] References Cited

U.S. PATENT DOCUMENTS 4,074,726 2/1978 Harris ..... 139/29

FOREIGN PATENT DOCUMENTS 42-10145 6/1967 Japan .
43-8579 4/1968 Japan .
45-702 1/1970 Japan .
135706 4/1977 Mexico .
1000294 8/1965 United Kingdom .
1042244 9/1966 United Kingdom .

*Primary Examiner*—Henry Jaudon
*Attorney, Agent, or Firm*—Lane, Aitken, Kice & Kananen

[57] ABSTRACT

A small table-top hand operated weaving apparatus on is disclosed upon which various patterned fabrics can be woven by extremely simplified operations thereof. In the disclosed apparatus, each heald member is mounted for movement along an inclined path with let-off and take-up rollers located on the same side relative to the path of the healds so that the warp yarns turn their direction at an angle, such as a right angle, at the healds. The heald members are automatically positioned selectively to either of the two end positions of their paths in accordance with a heald selection program by a manual reciprocating movement of a heald selection carriage movable transversely along the apparatus in order to form a desired shed with the warp yarns.

12 Claims, 9 Drawing Figures

HAND WEAVING APPARATUS

BACKGROUND OF THE INVENTION

This invention relates to a hand weaving apparatus, and, more particularly, to a home-type hand operated weaving apparatus of compact and lightweight construction which can be used on a table.

There have been proposed and in use various home-type hand weavers which are capable of producing pattern weaves such as twill and satin and color patterned fabrics in addition to plain weave, for instance, by selectively operating four harnesses through buttons for shedding the warp yarns in predetermined order according to an operational plan or a so-called weave diagram which has been prepared on the basis of intended design patterns.

The shedding operation according to such a complicated operational plan is disadvantageous and very inefficient since its preparation is rather difficult and time-consuming as requiring well as great concentration and labor on the part of the operator in order to operate the harness buttons correctly in a predetermined order. In addition, special dexterity and experience are required to perform such button operations without mistakes.

Moreover, since a conventional hand weaver of the abovementioned type is arranged such that each warp yarn passes a long, substantially horizontal path and a heald therefor is moved along a perpendicularly aligned path for shedding, such conventional hand weavers have a considerable length in the direction of the warp yarn path, which length necessitates a table for the hand weaver to also have a correspondingly considerable length.

SUMMARY OF THE INVENTION

With the foregoing in view, the present invention provides a hand weaving apparatus which eliminates the above-mentioned drawbacks which has a reduced size especially in its length, and on which various patterned fabrics can be woven by rather simple operations thereof.

According to the present invention, an improved hand weaving apparatus comprises a warp yarn let-off roller, a woven fabric take-up roller, a shedding arrangement for forming a shed with warp yarns intermediate between said let-off and take-up rollers, means for inserting a weft yarn across the so-formed shed, and manually operable reed means mounted to provide the back and forth movement to beating motion for therefor the weft yarn, the shedding arrangement comprising a plurality of heald elements adapted to individually engage respective warp yarns intermediate the let-off and take-up rollers, bed means having the heald elements mounted therein for individual movement between first and second end positions along respective paths which are inclined relative to the direction of movement of the reed means, manually operable selector means to selectively position the heald elements to the first and second end positions to locate the heald elements to different positions relative to the passage of the reed means thereby to cause the warp yarns to form a shed thereamong, the warp yarns being arranged to run at one side of the paths of the heald elements, and holding means operable to hold the heald elements to the end positions thereof determined by the selector means.

DETAILED DESCRIPTION OF THE INVENTION

Figure 1:
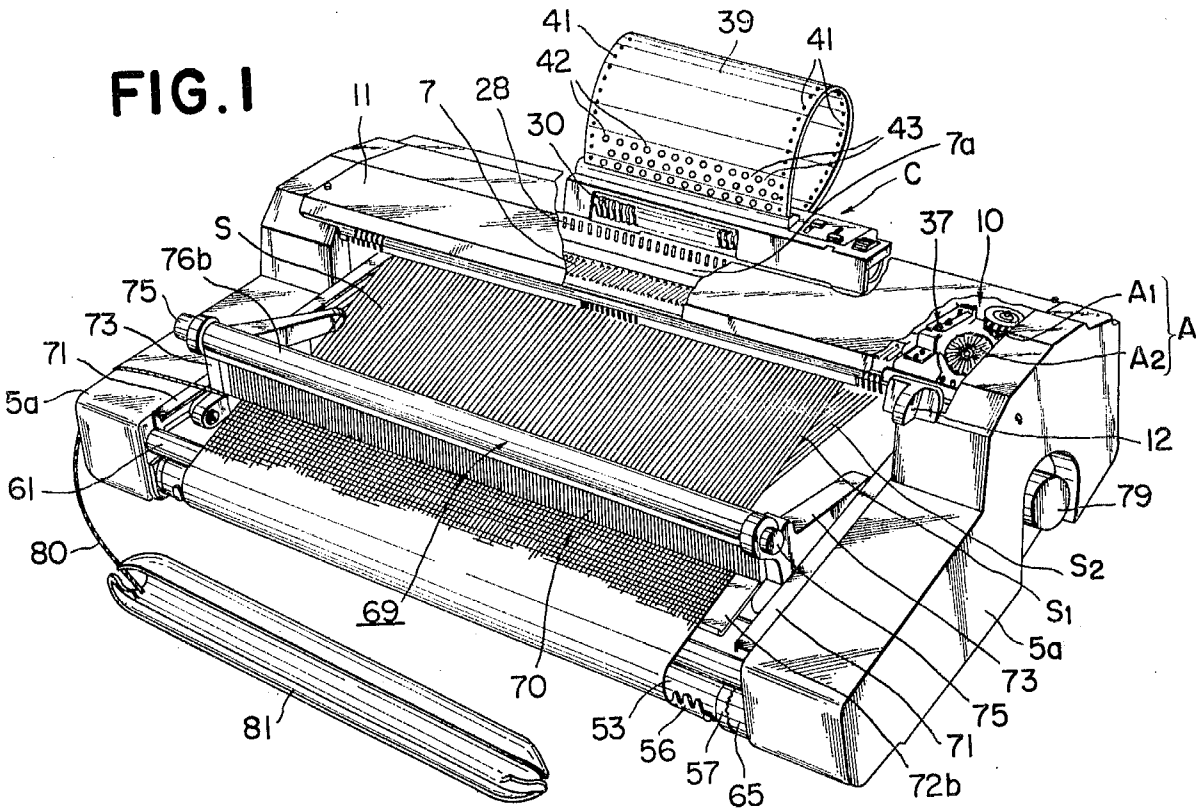
FIG. 1 is a perspective view of a hand weaving apparatus embodying the present invention.
Figure 2:
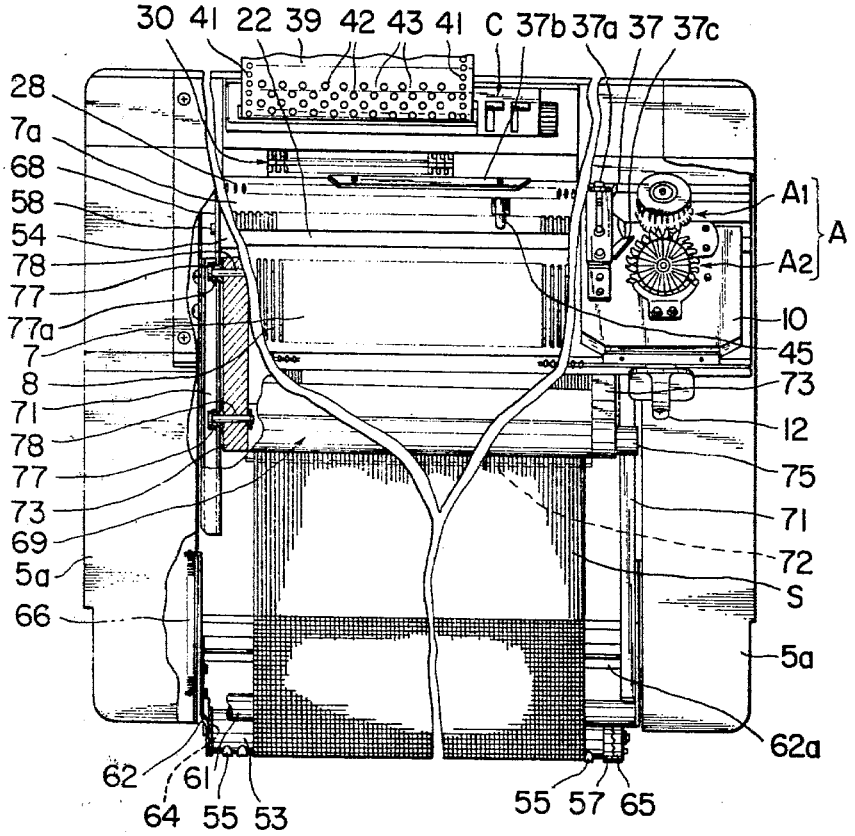
FIG. 2 is a plan view of the hand weaving apparatus, showing a take-up roller in a pulled-out position.
Figure 3:
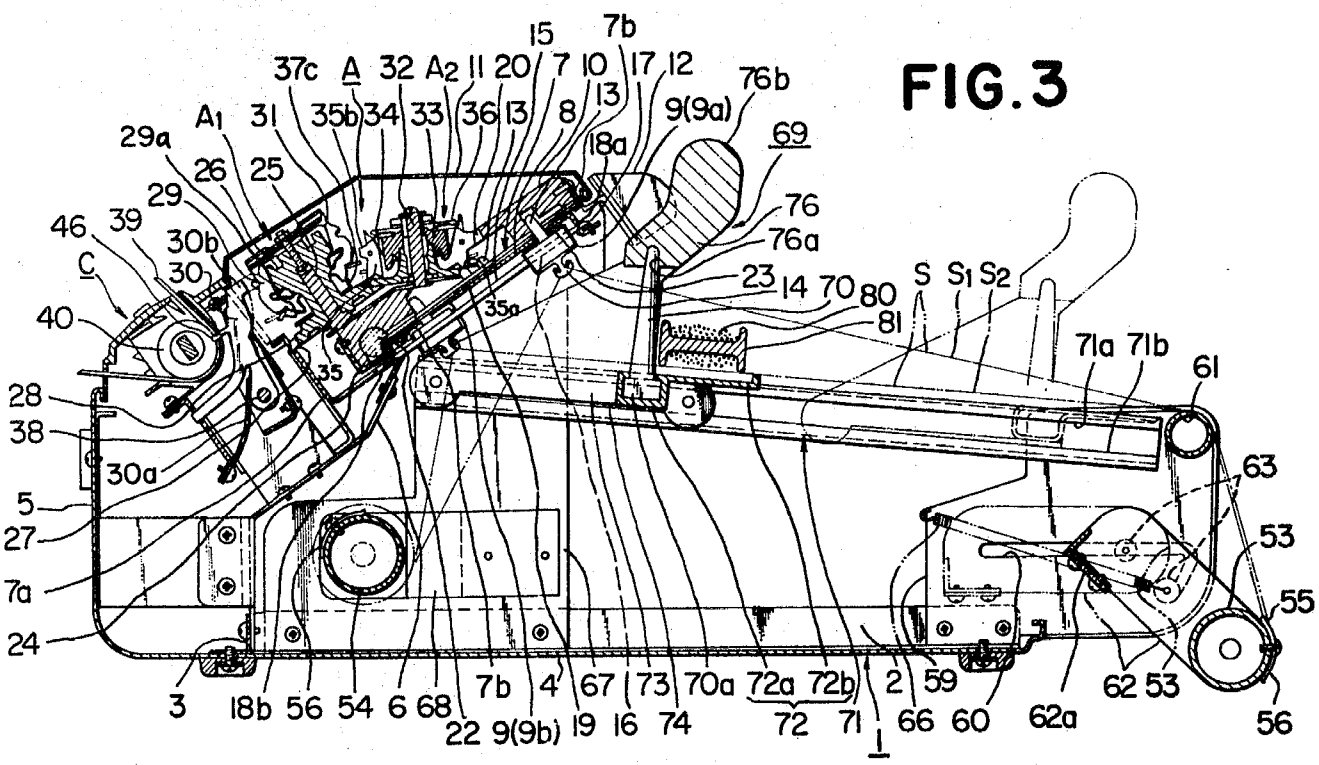
FIG. 3 is a vertical sectional view taken through the center of a program-providing device and a carriage in their cooperating position.
Figure 6:
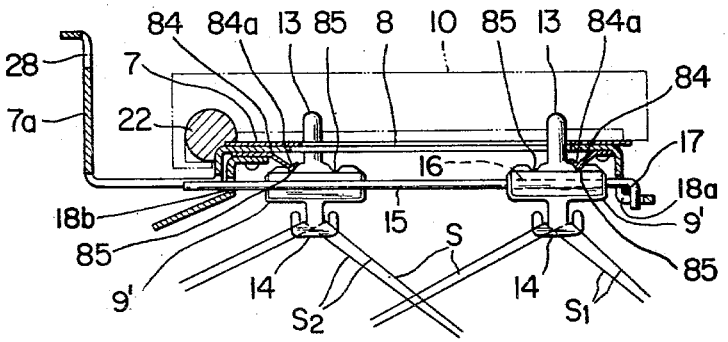
FIG. 6 is an enlarged vertical sectional view showing a modified bed construction.

A first embodiment of the present invention is shown in FIGS. 1–5 and includes a generally rectangular base 1 (FIG. 3) having a bottom section 4 and an upright rear wall section 5 formed integrally therewith. The base 1 includes right and left side walls 2 (only one of which is shown in FIG. 3) and a transverse wall 3 secured to the bottom section 4 thereof. A flat, elongated bed member or plate 7 (FIG. 2) is mounted on the hand weaving apparatus so that it extends from side-to-side relative the apparatus housing. The plate 7 includes a plurality of equi-spaced heald-receiving slots 8 (for example, fifty slots) and is secured in place by brackets 6 (only one of which is shown in FIG. 3) so that the slots 8 are aligned along the front-to-rear axis of the apparatus. The plate 7 is also mounted at an inclined angle relative the base plate 1 so that the forward end of the plate 7 is at a higher elevation than the rearwardly facing edge as shown in FIG. 3. A heald member 9 (the structure of which is shown in FIG. 6) is received in each slot 8 of the bed plate 7 for back and forth movement therealong. A travelling member or carriage 10 (the purpose of which is to effect heald selection as described below) is mounted for sliding movement on the bed plate 7 in the longitudinal direction (See FIG. 2) thereof. A top cover 11 (FIG. 1) is mounted on the bed plate 7 so as to cover the rear half of the apparatus, and a handle 12, for manual operation of the carriage 10, extends forwardly from below the top cover 11. The front half of the apparatus is open and defined at both sides by left and right side covers 5*a* fixed to the base 1.

The heald members 9 are each made of a flat strip of a synthetic resin material having a butt or head portion 13 and a pair of warp holding hooks 14 formed respectively on the top and bottom thereof. Each heald member 9 is slidably mounted on a guide rod 15 which is loosely fitted in a center hole 16 in the body of the heald member 9. Each guide rod 15 is located below and in parallel relation with the slot 8 of the bed plate 7 and has its L-shaped forward end passed through a slit 18*a* formed in the forward end of the bed plate 7 and its rear end passed through a hole 18*b* formed in the rear end of the bed plate 7. A metal locking wire or rod 17, which extends along the length of the bed plate 7, is inserted between the bent forward ends of the guide rods 15 and the bent forward end of the bed plate 7 to lock the guide rods 15 in a position supported by the bed plate 7 in parallel relation with the slots in the latter. Thus, the heald members 9 are supported on the guide rods 15 with their butts 13 projected above the bed plate 7 through the slots 8 therein and are movable back and forth within the range of the slots 8. The heald members 9 can be positively arrested at their front and rear end positions by means of a locking member or arrestor plate 19 provided on the underside of the bed plate 7, as hereinafter described in detail.

The pattern-to-be-woven on the apparatus is determined by the position of the individual healds 9 relative to slots 8, which positions, in turn, determine the relative positioning of the warp yarns that define the shed. In the present invention, the heald positions are set as the carriage 10 is moved from the right to the left (FIG. 1) relative to the base plate 7. The heald positioning is provided, as described more fully below, by a program providing device C (FIG. 1) that cooperates with sensor levers 30 (FIG. 3) to transfer, as the carriage 10 is moved relative to the plate 7, the heald pattern determining data through a pattern storage member A1 to a heald selection member A2 to effect the desired heald positioning.

The program providing device C is centrally mounted on the base rearwardly of the bed plate 7 and is adapted to provide heald setting information from a pattern card or paper 39 (FIGS. 1–3) of known type. The pattern paper 39 consists of an elongated rectangular card of synthetic resin material with a row of sprocket-engaging perforations 41 formed along each longitudinal edge thereof and a matrix of punched holed 43 located between the edge perforations 41 with this matrix of punched holes 43 representing the desired weave pattern. For example, the pattern card 39 shown in FIG. 1 represents a plain weave as determined by the presence or absence of holes 43 with punched holes 43 and unpunched areas 42 appearing in alternating relationship in each horizontal row. As shown in FIG. 1, the pattern card 39 is connected end-to-end to define and endless loop.

The pattern card 39 is carried on a feed roller 40 (FIG. 3) with the edge perforations 41 of the card 39 engaging sprocket wheels (not shown) provided on opposite ends of the feed roller 40. The pattern card 39 is incremented on a row-by-row basis only when the carriage 10 is moved from the left to the right in FIG. 1 to permit a cam follower lever 45 (FIG. 2) connected to the feed roller 40 through a feed mechanism (not shown) to engage an actuator cam 44 (FIG. 4) mounted on the rear side of the carriage 10 to actuate the feed mechanism to rotate the feed roller 40 by a predetermined angular increment to thereby feed the pattern card 39 on a row-by-row basis.

The information contained on the program card 39 in the form of punched holes 43 or unpunched areas 42 is detected by a plurality of pivotally mounted sensor levers 30 (FIG. 3) mounted adjacent to and forwardly of the feed roller 40. The sensor levers 30 are pivotally mounted on a support shaft 38 with the total number of sensor levers 30 provided corresponding to the total number of vertical information bearing columns (for example, 24 in the case of the preferred embodiment) provided on the program card 39. Each sensor lever 30 is pivotal between a rearward position as shown in solid line illustration in FIG. 3 and a forward position as shown by partial broken line illustration in FIG. 3. Each sensor lever 30 is normally biased in the forward direction (that is, clockwise about the mounting shaft 38) by a suitably mounted leaf spring 30*a* with each sensor lever 30 including a rearwardly facing projection 46 for detecting the presence or absence of the punched holes 43 when the sensing lever 30 is urged towards its rearward position in response to movement of the carriage 10 as described more fully below. As can be appreciated by those skilled in the art, when a particular sensing lever 30 faces a punched hole 43, the projection 46 of that sensing lever will pass or plunge through the hole 43 when the sensing lever is urged rearwardly in response to movement of the carriage 10 to permit the sensing lever 30 to move to its full rearward position, as shown in solid line illustration in FIG. 3. On the other hand, when the projection 46 of the sensing lever 30 faces an unpunched area 42, the projection 46 will contact the surface of the program card 39 when urged rearwardly and be prevented from moving to the rearward position. Thus, for any particular row pattern of punched holes 43 and unpunched areas 42, the corresponding sensor levers 30 will be maintained in a forward position or permitted to pivot to the rearward position depending upon whether the levers are facing an unpunched area 42 or a punched hole 43. Each sensing lever 30 also includes (FIG. 3) a forwardly facing tab 30*b* at its upper end with this tab being spacially positioned (as shown by the solid and broken line illustration in FIG. 3) in response to the presence of a hole 43 or unpunched area 42. The tabs 30*b*, as explained more fully below, cooperate with the drums A1 and A2 mounted on the carriage 10 to position the heald 9 members.

The carriage 10 is mounted on the bed plate 7 for bidirectional movement relative thereto and consists of a plate having an opening formed substantially at the center thereof. A heald selecting mechanism A (FIGS. 1, 2, and 3) and a shed forming mechanism B (FIG. 4) are mounted, respectively, on the top and bottom thereof. The carriage 10 is engaged, at its forward section, with the forward end of the top of the bed plate 7, and at its grooved rear section 21, with a rail 22 (FIG. 3) of a rounded cross section which is mounted on the bed plate 7 and extends along the rear end of the top of the bed plate 7 so that the carriage 10 can be slidably moved longitudinally along the bed plate 7 by manual operation of the handle 12. Blocking members 23 and 24 (FIG. 3), attached respectively to the front and rear of the carriage 10, extend under the forward edge and the rail 22 of the bed plate 7, respectively, to prevent the carriage 10 from being lifted away from the bed plate 7.

The heald selecting mechanism A includes a storage member $A_1$ adapted to temporarily store a heald selection program provided through the sensing levers 30 from the program-providing device C and a selection member $A_2$ adapted to store the program provided by the storage member $A_1$ thereon and select the heald members 9 in accordance with the program stored thereon.

The storage member $A_1$ (FIG. 3) includes a drum 26 mounted for rotation about a pivot pin 25 fixed in the rear portion of the carriage 10. The drum 26 has a gear 27 fixed at its lower end, which gear is engaged with a rack 28 formed in an upright wall 7*a* along the length of the bed plate 7 so that the drum 26 will rotate relative to its pivot pin 25 as the carriage 10 is moved relative to the bed 7 and the rack 28; the wall 7*a* being formed as a rear extension of the bed plate 7. A number of storage elements in the form of pivotable lever arms 29 are mounted radially at equidistant positions around the circumference of the drum 26 for pivotal or rocking rockable movement between a first normal position and a second position indicated respectively in solid and phantom lines in FIG. 3. Each lever arm 29 is adapted to be acted upon by a corresponding sensor lever 30 of the program-providing device C to be rocked from the first to the second position thereby to store a datum of the program thereon. Each lever arm 29 is engaged, at its top end, by a finger 31 of a leaf spring so that it is resiliently held in either of the first and second positions. It is to be noted that the program-providing device C may include, for convenience, up to twenty four sensor levers 30 so that the drum 26 may also include up to twenty four lever arms 29. As can be appreciated by those skilled in the art, as the carriage 10 is slid along the base plate 7, the drum 26 will rotate by virtue of its engagement with the rack 28 and cause each of its lever arms 29 to face and engage the aforementioned tabs 30*b* of the respective forwardly biased sensor levers 30 and urge those sensor levers rearwardly. For those sensor levers 30 that are facing an unpunched area 43 of the program card 39, the projections 46 of those sensor levers will prevent those levers from moving to their rearward position and the lever arm 29 of the drum 26 will be forced to and retained in its first normal position. On the other hand, if the sensor lever is opposing a punched hole 42, the projection 46 of that lever will enter the hole as the lever arm 29 of the drum contacts the tab 30*b* to allow the lever arm 29 to remain in its second position. Each lever arm 29 includes an outwardly extending tab 29*a* (FIG. 3) which is spatially positioned at the solid or broken line illustrated positions in FIG. 3 depending upon the aforedescribed position of the lever arm. The tabs 29*a* are used to set selection levers of the selection member A2 as described below. Thus, for each pass of the carriage 10, the lever arms 29 of the drum 26 will be positioned to their first or second positions depending upon whether or not the projections 46 of the corresponding sensing levers 30 are facing a punched or unpunched area.

The selection member $A_2$ includes a drum 33 mounted for rotation about a pivot pin 32 which is positioned substantially in the center of the opening 20 of the carriage 10 and supported by means of a support plate fixed on the carriage 10. The drum 33 has a gear 34 fixed at its lower end, which gear is meshed with the gear 27 of the former drum 26 for rotation thereby. The drum 33 may have up to 24 selector levers 35 pivotally mounted on the circumference thereof as in the case of the drum 26. Each selector lever 35 is rockable between a first normal position (as indicated by the so-positioned selector lever 35 on the right-hand side of the drum 33 in FIG. 3) in which position it is engageable, at its bent leg 35*a*, with the butt 13 of a heald member 9 to advance the heald member 9 to effect selection thereof and a second position (as indicated by the so-positioned selector lever 35 on the left-hand side of the drum 33 in FIG. 3) in which position the bent leg 35*a* is free or clear of the butt 13 of the heald member 9. Each selector lever 35 is also engaged, at its top end, by a finger of a leaf spring so that it is held in either of its first and second positions.

The selector levers 35 of the drum 33 are oriented so that the selector levers 35, as the drum 33 and the drum 26 are rotated by virtue of the inter-engaging gears 27 and 34, are sequentially presented to corresponding lever arms 29 of the drum 26 so that the selector levers 35 are either maintained in their first position if the tab 29*a* of the corresponding lever 29 is positioned to clear the portion 35*b* of the selector lever 35 or rock selector lever 35 to its second position if the tab 29*a* of the corresponding lever 29 is positioned to engage the portion 35*b* of its corresponding selector lever 35.

As described above, the heald selection takes place during the manual movement of the carriage 10 from the right to the left by virtue of the inter-cooperation of the program card 39, sensor levers 30, the lever arms 29 of the drum 26, and the selector levers 35 of the drum 33. During the preceding left to right movement of the carriage 10, the lever arms 29 and selector levers 35 are reset to a cleared position by a reset mechanism 37 so that the various levers can be properly set in accordance with the punched hold pattern on the program card 39 on the subsequent right-to-left movement of the carriage 10. The reset mechanism 37 includes an actuating member 37*a* (FIG. 2) which engages a cam-like clearing bar 37*b* positioned forwardly of the program providing device C. When the elements 37*a* and 37*b* are engaged, a plate 37*c* (FIG. 1) cooperates in a known manner with the selection mechanism A to clear or reset the lever arms 29 and the selector levers 35 to their respective first home positions to clear the data stored thereon.

Figure 4:
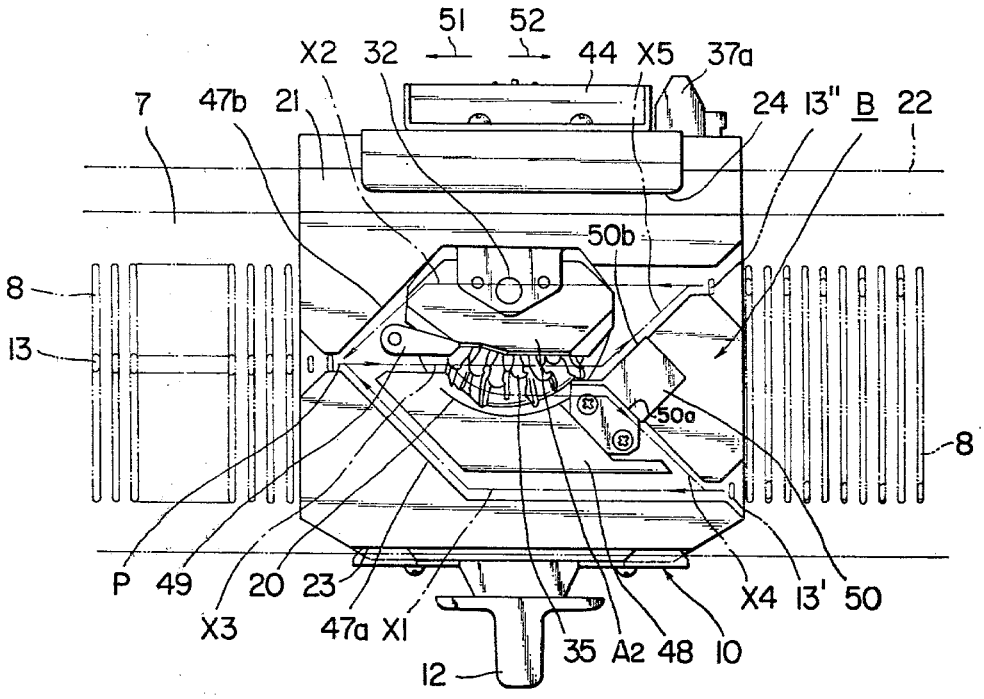
FIG. 4 is an enlarged bottom view of the carriage shown in FIG. 3 with the carriage and shed forming cams mounted on the bottom thereof shown in solid line illustration and a partial view of a bed plate upon wich the carriage is mounted and which underlies the carriage shown in phantom dash-dot-dot-dash illustration.
Figure 5:
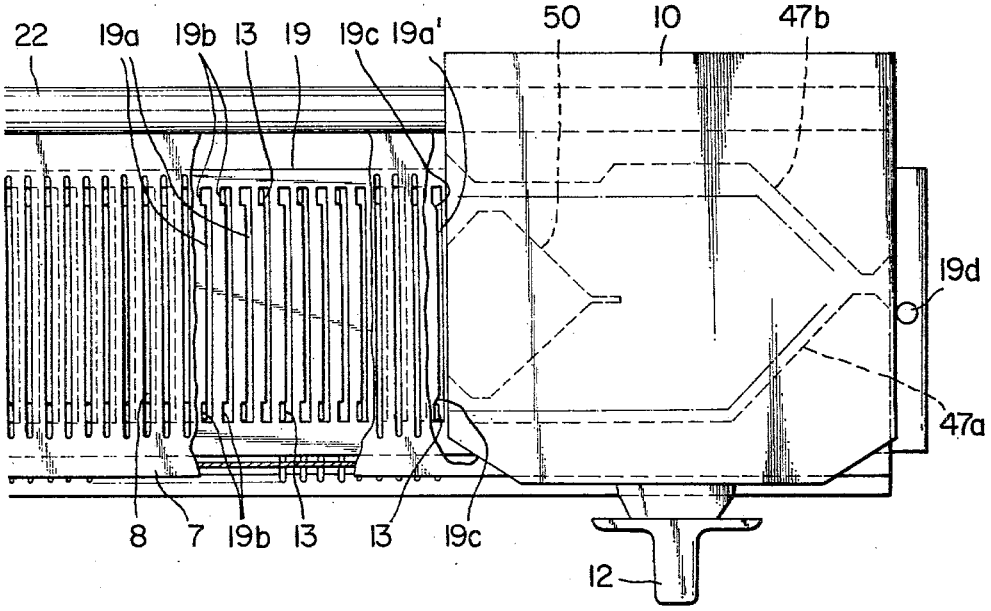
FIG. 5 is an enlarged top plan view, showing the carriage mounted on a bed member with the shed forming cams illustrated in FIG. 4 shown in broken line illustration and with selected portions of the underlying bed plate broken away for reasons of clarity.

The shed-mechanism B, which is located on the underside of the carriage 10 as shown in FIG. 4, consists of a cam mechanism mounted on the carriage for engagement with the butts 13 of the heald members 9 to move them back and forth along their paths defined by the slots 8 in the bed plate 7. As explained more fully below, when the carriage 10 is moved in the direction of the arrow 52 in FIG. 4, the butts 13 of healds 9 that are in their forward or rearward end position in their respective slots 8 are, respectively, retracted to or advanced to an intermediate position; and, when the carriage 10 is moved in the direction of arrow 51, the so-intermediate positioned butts 13 are presented to the lower portions of the lever 35 of the heald selection mechanism A2 which then contacts and moves or clears the butts 13 (depending upon the position of the respective levers 35 as determined by the aforedescribed selection member A1, its levers 29, the sensor levers 30, and the program card 39) so a shedding cam may direct the contacted butts 13 to their forward end position and the cleared butts 13 to their rearward end position. The cam mechanism includes a pair of collecting cams 47*a* and 47*b*, a partition cam 48, a guide cam 49, and a shedding cam 50 mounted on the underside of the carriage 10, as shown in FIG. 4. The collecting cams 47*a* and 47*b* are arranged substantially symmetrically in the front and rear of the carriage 10, and the front collecting cam 47*a* provides, together with the partition cam 48 arranged in front of the heald selection member $A_2$, a butt path $X_1$ for retracting the heald members 9 in their slots 8 from the forward end position (illustrated by the butt 13′ in FIG. 4) to an intermediate or central position whereas the rear collecting cam 47b provides a butt path $X_2$ for advancing the heald members 9 in their slots 8 from the rear end position (illustrated by the butt 13" in FIG. 4) to the intermediate position.

The guide cam 49 is arranged adjacent the junction P of the butt paths $X_1$ and $X_2$, and provides, behind the partition cam 48, a butt path $X_3$ for preventing undesired rearward movement of the heald members 9 to conduct the butts 13 of the latter to the selection mechanism $A_2$. The shedding cam 50 is arranged between the front and rear collecting cams 47a and 47b on the outer side of the selection mechanism $A_2$ (that is, on the side of the selection mechanism $A_2$ opposite from the guide cam 49), and provides butt paths $X_4$ and $X_5$ for displacing the heald members 9 to the front and rear end positions in the slots 8, respectively.

In operation, when the carriage 10 is moved in the direction of an arrow 51 of FIG. 4, the butts 13 of the heald members 9 (having been in the central, collected position) are conducted via the junction P along butt path $X_3$ where they are presented to the lower portions 35a of the levers 35 of the selection mechanism $A_2$. As the carriage 10 is moved in the direction of the arrow 51, the selection mechanism A2 rotates causing successive levers 35 to enter the butt path $X_3$. Depending upon the position of the levers 35 of the selection mechanism A2 (as determined by the levers 29 of the selection mechanism A1, the sensor levers 30, and the program card 39) selected ones of the so-presented butts 13 of the healds 9 will be physically contacted by the associated levers 35 and displaced forwardly to a butt-path $X_4$ while the remaining, nonselected ones of the so-presented butts 13 will clear their associated levers 35 and remain in their intermediate location along butt path $X_3$. Those butts 13 that were displaced to the butt path $X_4$, with continued movement of the carriage 10 in the direction of the arrow 51, will contact the cam side 50a of the shedding cam 50 with the butts 13 and their healds 9 moved to the forward end position in their respective slots 8 (butt 13' in FIG. 4). Those butts 13 which were not contacted by the respective levers 35 of the selection mechanism A2 will remain in butt paths $X_3$ and, with continued movement of the carriage in the direction of the arrow 51, will contact the cam side 50b of the shedding cam 50 and be moved to the rearward end position of the slots 8 (butt 13" of FIG. 4).

On the other hand, when the carriage 10 is moved in the direction of an arrow 52, the butts 13 of the heald members 9 (having been at the front and rear end of the slots 8) are guided through the butt paths $X_1$ and $X_2$, respectively, to be displaced to the central collected positions by contact with the collecting cams 47a and 47b.

Thus, a sliding movement of the carriage 10 in the direction of the arrow 51 of FIG. 4 causes the heald members 9 to be automatically selectively brought to the front or rear end position depending upon the weave pattern program transmitted from the program carrier 39 through the sensor levers 30, the levers 29 of the selection member A1, and, finally, the levers 35 of the selection member A2. A reverse movement of the carriage 10 in the direction of the arrow 52 causes the heald members 9 to be automatically brought from the forward or rearward end position to the intermediate stand-by position of the slots 8 and, as described above, the clearing mechanism 37 (FIG. 1) to clear or reset the levers 35 and 29. Accordingly, it is to be understood that a reciprocation of the carriage 10 starting from the right hand end position on the bed plate 7 will reflect the heald selection program or signals onto the heald members 9 selectively positioned to the front or rear end positions thereof.

The aforementioned locking member 19 is provided to lock the healds 9 in their selected forward or rearward end positions after the healds have been so-positioned by the heald selection mechanism A during movement of the carriage 10 in the direction of arrow 51 in FIG. 4 and unlock the so-positioned heald during movement in the opposite direction (arrow 52 in FIG. 4) when the healds are moved from their forward or rearward end positions to the intermediate position. The locking member 19 is in the form of a flat plate that is substantially co-extensive with the bed plate 7, mounted immediately therebelow and contiguous therewith for relative sliding movement between butt 13 locking and unlocking positions. As shown in FIG. 1, the locking member 19 is mounted by its front and rear edges for sliding movement on a guide member 7B. The locking member 19 includes a plurality of elongated slots 19a that are equal in number and spacing to the slots 8 of the bed plate 7. Each of the slots 19a includes a butt trap in the form of a notch located at the forward and rearward end positions of the slots 19a with both notches of each slot located on the same side thereof. The notched-like traps on the right-most slot 19a'. (FIG. 5) differ from the remaining notches in that cam surfaces 19c are provided that are obliquely aligned relative to the longitudinal axis of the slots 19a. The locking member 19 is shiftable between a non-locking and a locking position. In the non-locking position, the locking member 19 is shifted so that the slots 19a thereof are in registration with the slots 8 of the bed plate 7 so that the butts 13 may extend through the so-registered slots 8 and 19a and move therealong, and a non-locking position in which slots 19a of the locking member 19 are shifted relative to their respective slots 8 of the bed plate 7 so that only the notch-like trap portions of the notches 19a remain in registration with the slots 8 of the bed plate 7.

The locking member 19 is caused to shift between its non-locking position and its locking position in response, respectively, to leftward and rightward movement of the carriage 10 relative to the bed plate 7. When the carriage 10 is moved leftward from its rightmost position in FIG. 5, (in which case the healds 9 have been previously moved to their selected end positions and the locking member has been previously shifted rightward relative to the bed plate 7 to lock the healds in place, as well be evident from the description below), the end-positioned butts 13 will move along butt paths $X_1$ and $X_2$ to the front and rear collecting cams 47a and 47b (FIG. 4) which will initially encounter and force the end positioned butt 13 in the slot 19a' (FIG. 5) towards the aforementioned intermediate or central position. As the butt 13 is forced to the central position, it will forcibly move against the cam surface 19c of the slot 19a' and cause the locking member to shift leftward in FIG. 5 relative to the bed plate 7 to the non-locking position. With this shift to the non-locking position, all the slots 19a will be shifted into registration with their respective slots 8 of the bed plate 7, and, the as the carriage continues to move, will force the now unlocked butts 13 to the aforedescribed intermediate position.

When the carriage 10 reaches its leftward most position and its direction of movement is thereafter reversed, the butts will be moved to the forward or rearmost position depending upon the heald selection program as described above. When the carriage 10 reaches the right most position of its travel and all of the butts 13 and their associated healds 9 have been positioned in accordance with the program, the carriage will contact a pin 19*d* secured to the locking member 19 and cause the locking member 19 to shift rightward to lock the so-positioned butts 13 and their healds 9 in place.

A take-up roller 53 and a let-off roller 54 (FIG. 3) are mounted transversely in the front and rear portions of the base 1, respectively, each having a comb-like yarn hooking plate 56 provided with a series of hooking dents 55 along the entire length thereof for holding the ends of warp yarns. Each of the rollers 53, 54 has a serrated joint 57 secured to its one end (the right end in FIGS. 1 and 2) and has a journal 58 at the other end.

Upright support plates 59 are mounted on the base 1 adjacent the forward ends of the side walls 2 and having each a J-shaped guide groove 60 formed in the middle portion thereof. The support plates 59 support a front guide roller 61 over the take-up roller 53 for guiding the woven fabric to the latter. The take-up roller 53 has its opposite ends supported on a pair of arms 62 which are each made of a resilient material such as a leaf spring and linked to each other at the rear ends thereof by a connecting bar 62*a*. A pair of small rollers 63 rotatably mounted at front and rear positions on each arm 62 are received in the guide groove 60 in the latter so as to be movable back and forth in and along the guide groove 60. One of the paired arms 62 (the left one in FIG. 2) has a journal-bearing hole 62 formed adjacent the forward end thereof which loosely receives the journal 58 of the take-up roller 53, and the other arm 62 has a serrated joint 65 secured to the inner side thereof. Tension springs 66 are connected between the front ones of the rollers 63 and the support plate 59.

The take-up roller 53 can be mounted on the arms 62 by forcing the arms 62 to slightly flex apart from each other, then engaging the serrated joint 57 at one end thereof with the serrated joint 65, and finally fitting the journal 58 at the outer end in the bearing hole 64 (FIG. 2). The take-up roller 53 thus held between the arms 62 is rotatable in a winding-up direction (clockwise in FIG. 3) due to slippage of the serrated joint 57 on and relative to the fixed serrated joint 65, but its reverse rotation is blocked by the meshed engagement of the serrated joints 57 and 65 with each other.

The take-up roller 53 is shiftable between a retracted position receded between the side covers 5*a* by the biasing force of the tension springs 66 (the position shown in phantom in FIG. 3) and a forwardly extended position pulled out forwardly of the side covers 5*a* with the front ones of the rollers 63 positioned at the crooked lower ends of the guide grooves 60 against the action of the springs 66 (the position in solid line in FIG. 3).

The let-off roller 54 has its opposite end supported on arms 68 (FIG. 3) mounted on upright support brackets 67 which are secured at both side of the bed 1 adjacent the rear portions of the side walls 2. The let-off roller 54 is supported in a manner similar to the take-up roller 53 except that the arms 68 are securely fixed to the support plate 67 at the respective base ends. The structural parts of the let-off roller 54 common to the take-up roller 53 are designated by common reference numerals and their structural and functional description is omitted to avoid repetition.

A reed 69 (FIGS. 1, 2, and 3) having a multitude of dents 70 supported in upright positions thereon is mounted for back and forth movement along a path which is slightly inclined with its rear end arranged a little higher than its forward end. In particular, the reed 69 includes a reed support 72 having a dent holder section 72*a* of a substantially C-shaped cross section for accommodating therein bulged lower ends of the dents 70 and a forward extension 72*b* extending horizontally in the forward direction from the dent holder section 72*a*. The opposite ends of the reed support 72 are secured by fastening screws to a pair of mounting plates 73 so as to prevent dislodgement of the dents 70 from the reed support 72. Mounted detachably on and between the side plate 73 is a reed cover 76 having on its underside a row of grooves 76*a* for receiving the upper ends of the dents 70 so as to maintain the dents 70 in uniformly spaced relation. The reed cover 76 is thus removed when warp yarns are to be inserted from above in position in the space defined between two adjacent dents 70. The reed cover 76 has a gripping portion 76*b* on the top thereof for back and forth manual movement of the reed 69.

A pair of small rollers 77 are mounted at front and rear positions on each side plate 73. Each roller 77 has an annular groove 77*a* formed around its circumference for engagement with a guide rail 71 of a substantially C-shaped cross section which is mounted on and extends between the support plates 59 and 67 and is inclined such that the rear end thereof is arranged a little higher than the forward end. Upper and lower marginal edges 71*a* and 71*b* of the guide rails 71 extend tangentially into the annular circumferential grooves 77*a* of the rollers 77 so that spontaneous transverse movements of the reed 69 are suitably blocked during movement along the rails 71. The reed 69 can be thus moved, if necessary, to a position immediately behind the front roller 61 by pulling the reed 69 at the grip 76*b* therefor.

The operations of the above-described weaving apparatus are now explained in relation with plain weave. In the first place, 100 warp yarns S are drawn between the take-up roller 53 and let-off roller 54 passing through the reed 69, and are hooked by the heald members 9 intermediately between the let-off roller 54 and reed 69, alotting two warp yarns to one heald member 9, that is to say, one on each hook 14 of the latter, and the reed 69 is suitably positioned adjacent the front guide roller 61. Thus, the warp yarns S extend between the front guide roller 61 and the respective hooks 14 substantially in a horizontal direction while they extend between the respective hooks 14 and the let-off roller 54 substantially in a vertical direction, as seen from FIG. 3. Further, a punched card 39 for plain weave is set on the program-providing device C. The punched card 39 for plain weave contains a matrix of signals in which a punched hole and an unpunched area appear alternately both in horizontal rows and vertical columns of signals, as mentioned hereinbefore. A suitable length of weft yarn 80 is preloaded on a shuttle 81.

Now, the carriage 10 is moved to the left from the position shown in FIG. 1. At the beginning of such leftward movement of the carriage 10, the butt 13 of the rightmost heald member 9 is engaged to move it from its end position by either one of the collecting cams 47*a* and 47*b* to thereby shift the locking member 19 to the non-trapping position to release the butts 13 of the succeeding heald members 9, as hereinbefore described. As the carriage 10 is further moved to the left, the butts 13 of succeeding heald members 9 in the front or rear end positions are collected towards the center of the slots 8 by the action of the shed-forming mechanism B. Thus, the heald members 9 are aligned in the intermediate stand-by positions at the center of the slots 8, along with the warp yarns S ($S_1$ and $S_2$). In the meantime, the reset mechanism 37 is actuated to clear the stored signals in the heald selection mechanism A which have been provided during the preceding reverse movement (that is, the previous left to right movement) of thecarriage 10, and then the heald selection mechanism A receives to store therein new selection signals for the next shed given by the program-providing mechanism C.

After the arrival of the carriage 10 at the left end of the passage, it is now moved to the right towards the positions of FIG. 1. During this movement, the butts 13 of the heald members 9 in the intermediate stand-by positions are successively admitted into the carriage 10 along the butt path $X_3$ and alotted alternately to a front or a rear position by the heald selection mechanism A according to the selection signals on the pattern paper 39 as described above. With further rightward movement of the carriage 10, the butts 13 are displaced all the way to the front and rear end positions in the slots 8 by the operation of the shed-forming mechanism B. During this rightward movement of the carriage 10, the aforementioned feed mechanism is actuated to feed the pattern paper 39, bringing the next row of selection signals in position.

As soon as the carriage 10 comes into abutting engagement with the pin 19*d*, the locking member 19 is shifted to the trapping position, locking the butts 13 of the heald members 9 in the traps 19*b* at the selected front and rear end positions. Since the bed plate 7 is arranged to be inclined such that its forward end is suitably raised high relative to its rear end, the warp yarns S are differentiated in the vertical direction in accordance with the positions of the heald members 9 in the bed member 7 to form a shed therebetween. Thus, the yarn S held in the hooks 14 of the raised heald members 9 in the front end position in the bed plate 7 (two yarns on each heald member) form an upper lay $S_1$ of the shed tensioned and inclined between the upper end of the bed plate 7 and the front guide roller 61, while the yarns S held in the hooks of the lowered heald members 9 in the rear end position (also two yarns on each heald member) form a lower lay $S_2$ of the shed tensioned substantially horizontally between the lower end of the bed plate 7 and the front guide roller 61 (FIG. 3).

Subsequently, the reed 69 is moved rearwardly and the shuttle 81 is passed through the shed along the shuttle passage over the forward extension 72*a* of the reed support 72 to fill or insert the weft yarn 80 (FIG. 3) therein, and then the reed 69 is moved forwardly to beat the inserted weft yarn 80 at the cloth fell, thereby interweaving the weft yarn 80 alternately with two yarns.

If the carriage 10 is moved again first to the left and then to the right, the positions of the heald members 9 are switched, the warp yarns $S_2$ now forming the upper lay of the shed and the warp yarns $S_1$ forming the lower lay of the shed in thus reversed positions. The weft yarn 8 is inserted again in a similar manner across the shed thus formed and interwoven alternately with two warp yarns S.

Similar operations are repeated to produce a piece of woven cloth. The position of the cloth fell retreats gradually as the weaving operations proceed so that the take-up roller 53 and let-off roller 54 are suitably manipulated from time to time during the weaving operations to take up the woven cloth on the former roller 53 while letting off unwoven warp yarns from the latter roller 54, thereby maintaining the cloth fell at a suitable position. The take-up roller 53 is pulled out to the projected position when the woven cloth has been accumulated on the roller 53 into an excessive thickness, as shown in FIG. 2.

FIG. 6 shows a modified bed construction including modified heald and locking members therein. Those parts which are same as in the foregoing embodiment are designated by same reference numerals and their description is omitted.

This modified bed construction includes a plurality of modified heald members 9' each having a pair of recesses 85 formed in the upper edge thereof on both sides of the butts 13. It further includes a pair of modified locking members 84 each formed of a resilient material such as a leaf spring and secured, at their one ends, to the bed plate 7 adjacent the front and rear ends of the slots 8 in the latter. These locking members 84 underlie the bed plate 7 and have each a plurality of angularly bent claws or fingers 84*a* which are each arranged to resiliently engage in a recess 85 of a corresponding heald member 9' to positively hold the latter in the forward or rear end position of its own path. Thus, if a heald member 9' is moved to its end position, forward or rear, it is engaged, at the recessed portion 85 thereof, with a corresponding resilient finger 84*a* arranged in alignment therewith so that it is held there until it is forced from the end position by means of the shed-forming mechanism on the carriage 10.

It is to be understood that, although the modified bed arrangement is illustrated as being disposed in a horizontal position in FIG. 6, it can also be disposed in a suitably inclined position as in the arrangement of the first embodiment.

Figure 7:
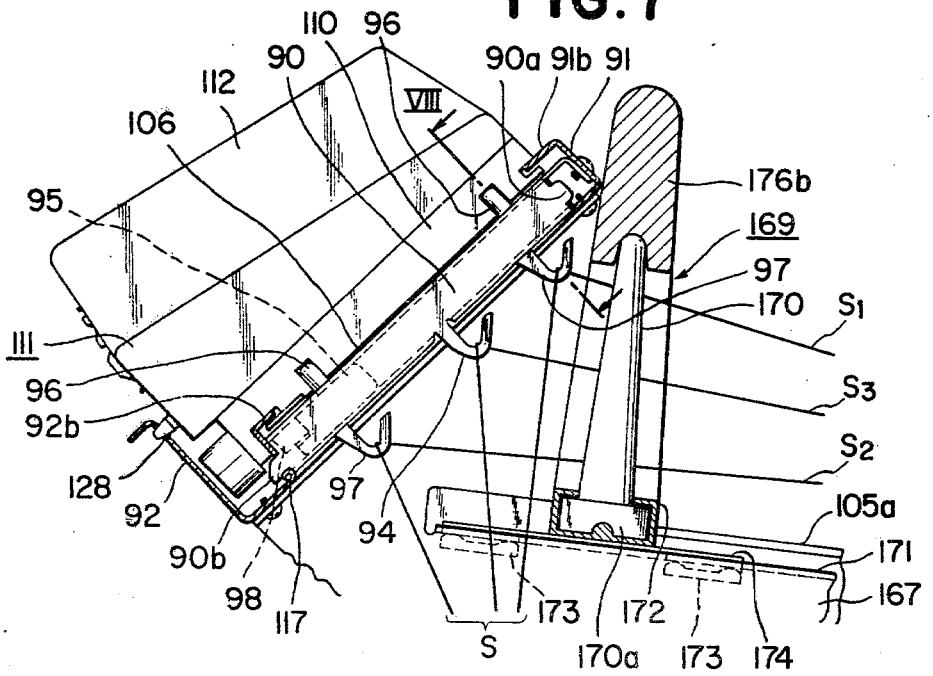
FIG. 7 is a fragmentary vertical sectional view, showing another modified bed construction together with a modified reed means.
Figure 8:
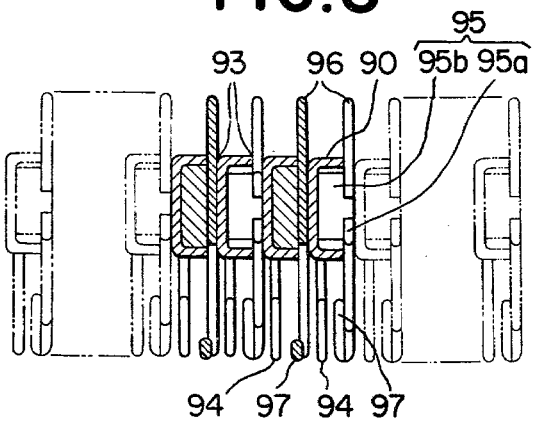
FIG. 8 is a sectional view take along line VIII—VIII of FIG. 7.
Figure 9:
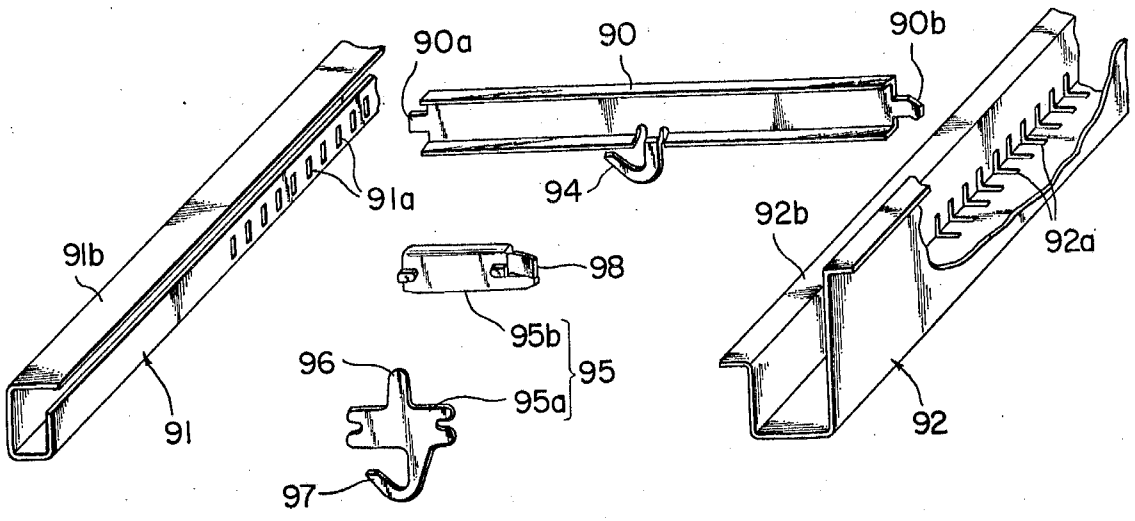
FIG. 9 is an exploded view of the bed construction of FIG. 7.

FIGS. 7 to 9 show another modified bed construction, together with a modified reed, wherein warp yarn holders or hooks are enabled to assume three different vertical positions to form two sheds thereamong in order that greater freedom to selection of warp yarns and accordingly of design patterns to be woven on the weaving apparatus may be obtained.

The bed arrangement comprises a bed member or assembly 106 which includes front and rear support bars 91 and 92 and a number of cross or guide members 90 of channel-like cross section each having connecting tabs 90*a* and 90*b* at the forward and rear ends thereof. The front and rear connecting tabs 90*a* and 90*b* of the guide members 90 are fitted in uniformly spaced slits 91*a* and 92*a* formed in the front and rear support bars 91 and 92, respectively. The rear connecting tabs 90*b* are anchored in the respective slits 92*a* in the rear support bar 92 by a metal locking wire or rod 117 similar to the metal locking wire 17 of the foregoing first embodiment, fixing the guide members 90 in uniformly spaced positions along the length of the front and rear support bars 91 and 92 so as to form slots between two adjacent guide members 90.

Each guide member 90 has a hook-shaped warp holder 94 integrally provided on the lower side thereof. A heald member 95 is received in each slot 93 for slidable movement therealong. A carriage 110 is mounted for slidable movement on the bed member 106 in the longitudinal direction of the latter.

As shown in FIGS. 8 and 9, each heald member 95 consists of a first-strip 95*a* having a butt 96 and a hooked warpholding leg 97 integrally formed on the upper and lower sides thereof, and a second flat strip 95*b* secured to the first strip 95*a* and having a braking portion 98 (FIG. 9) at its rear end. The first strip 95*b* of the heald member 95 is received in the space between the upper and lower walls of the guide member 90 with its braking portion 98 resiliently abutted against the side wall of an adjacent guide member 90. In this position, the butt 96 of the heald member 95 is projected above the upper surface of the bed member 96, and the heald member 95 is slidable back and forth within the respective slot 93 against the braking action of the braking portion 98 and can be frictionally retained at a desired position within the slots 93 due to the just-mentioned action of the braking portion 98.

Similarly to the first embodiment, the carriage 110 has heald selecting and shed forming mechanisms (not shown) provided thereon and is slidably supported on guide rails 91*b* and 92*b* in the form of rearwardly and forwardly bent extensions of the front and rear support bars 91 and 92, respectively. The carriage 110 has a top cover 111 mounted thereon which has an upwardly projecting grip portion 112 integrally formed at the center thereof, by which the carriage 110 is manually slided on and along the bed member 106.

In this embodiment, the reed and the support therefor are simplified as compared with those of the first embodiment. A reed 169 having a multitude of dents 170 thereon is movably supported on a pair of slightly downgraded guide rails 171 which are mounted on the inner side of side covers 105*a* (only the right one is shown) at opposite lateral ends of a base similar to the aforementioned base 1. The reed 169 likewise has a dent holder 172 of substantially U-shape in cross section which receives bulged lower ends of the dents 170. The upper ends of the dents 170 are fitted in the uniformly spaced grooves on the underside of a reed cover 176*b* to maintain them in uniformly spaced positions.

A pair of sliders 173 are provided in the front and rear portions of left and right mounting plates 174 (only right one is shown) which are secured to the opposite ends of the dent holder 172. The sliders 173 are fitted on the rails 171 so as to support the reed 169 for back and forth movement therealong.

In this embodiment, a half number of the drawn warp yarns are held in the centrally positioned fixed warp holders 94 as indicated at $S_3$ in FIG. 7 and the other half of the warp yarns are held in the warp holders 97 which are displaceable between the upper and lower end positions as indicated at $S_1$ and $S_2$ in the same figure. Therefore, two upper and lower sheds are formed in this arrangement, one on each side of the intermediate warp yarns $S_3$. It may be readily understood that insertion of a weft yarn across the upper shed will divide the warp yarns into a first group of yarns $S_1$ and a second group of yarns $S_3$ and $S_2$ whereas insertion across the lower shed will divide them into a first group of yarns $S_1$ and $S_3$ and a second group of yarns $S_2$.

The weaving operations of this embodiment are substantially same as those of the first embodiment but it enables to insert two or more weft yarns of different colors both in the upper and lower sheds at a time and also to selectively use the upper and lower sheds to obtain a variety of more complicated weave patterns. If desired to produce plain weave as described in reference to the first embodiment, all the movable yarn holders 97 will be positioned in unison alternately first to the upper end position and then to the lower end position to from a single shed alternately on the upper and lower side of the intermediate lay $S_3$. The pattern paper for such plain weave will contain a matrix of punched and unpunched signals providing such selection of the heald members. It is also possible to use the weaving apparatus exactly in the same manner as in the first embodiment, without drawing any warp yarns through the fixed center holders 94.

What is claimed is:

1. In a hand weaving apparatus having a warp yarn let-off roller, a woven fabric take-up roller, a shedding arrangement for forming a shed with warp yarns intermediate between said let-off and take-up rollers, means for inserting a weft yarn through the shed formed, and a manually operable reed means mounted for back and forth movement for beating motion for the weft yarn inserted, the improvement wherein said shedding arrangement comprises a plurality of heald elements adapted to individually engage with the warp yarns intermediate between said let-off and take-up rollers, bed means having said heald elements mounted therein for individual movement between first and second end positions along their own paths which are inclined relative to the direction of movement of said reed means, manually operable selector means manually operable to selectively position said heald elements to said first and second end positions to locate said elements to different positions relative to the passage of said reed means thereby to cause the warp yarns to form a shed thereamong, the warp yarns being arranged to run at one side of said paths of said heald elements, and holding means operable to hold said heald elements to said end positions positioned thereto by said selector means.

2. Hand weaving apparatus as claimed in claim 1 wherein each of said heald elements has a butt extending above said bed means, and said selector means includes a travelling member slidably mounted on said bed means for movement transverse to said paths of said heald elements, said travelling member having a cam mechanism mounted thereon for engagement with the butts of said heald elements, said cam mechanism including first cam means for bringing said heald elements from said first and second end positions to an intermediate position, a selector member for selecting said heald elements, and second cam means for bringing the selected heald elements to said first positions and the remaining heald elements to said second positions.

3. Hand weaving apparatus as claimed in claim 2 wherein said selector member is a mechanical data storage drum having thereon a plurality of arms settable to actuate said heald elements in a pattern, and said selector means further includes a control device including a data carrier having patterning data thereon and operable to automatically set said arms of said selector member in accordance with said patterning data on said data carrier.

4. Hand weaving apparatus as claimed in claim 2 wherein said bed means includes a plate member having formed therein a plurality of slots for guiding said heald elements at said butts thereof along said paths, and support rods removably mounted on said plate member in a parallel relation with said slots and having said heald elements mounted for slidable movement thereon.

5. Hand weaving apparatus as claimed in claim 4 wherein said holding means includes an arrestor plate mounted on and frictionally engaged with said plate member and having a plurality of slots formed therein which correspond to said slots in said plate member, said arrestor plate having a notch formed adjacent each end of each slot therein, said arrestor plate being manually shiftable between a first position in which said slots therein are aligned with said slots in said plate member so that said heald elements are movable in the thus aligned slots between said first and second end positions and a second position in which said notch therein is aligned with its corresponding slot in said plate member so that said heald elements are held in either of said end positions.

6. Hand weaving apparatus as claimed in claim 5 wherein said arrestor plate has at one end thereof an abutment member mounted for engagement by said travelling member during movement of the latter towards said one end of said arrestor plate to bring said arrestor plate from said first to said second position.

7. Hand weaving apparatus as claimed in claim 6 wherein said arrestor plate has, adjacent either notch of at least that one of said slots therein which is in the nearest to said abutment member thereon, a camming edge adapted to be engaged by the associated heald element upon movement of the element from the end positions thereof to shift said arrestor plate from said second to said first position thereof, said associated heald element being engaged to be forced out of the end positions by said first cam means on said travelling member upon movement of the member from said one end of said arrestor plate.

8. Hand weaving apparatus as claimed in claim 4 wherein said holding means includes a spring element located adjacent each of said end positions of said heald elements to frictionally engage with the associated heald element to hold same in the end position.

9. Hand weaving apparatus as claimed in claim 2 wherein said bed means includes a pair of parallelly arranged support members, a plurality of cross members supported on said support members and each defining a channel for slidably accommodating a heald element therein, and a locking rod for locking said cross members in position on said support members.

10. Hand weaving apparatus as claimed in claim 9 wherein said holding means includes a resilient finger formed on each of said heald elements and frictionally engaged with a wall of an adjacent cross member.

11. Hand weaving apparatus as claimed in claim 1 wherein each of said heald elements has, at said one side of the path thereof, a hook adapted to engage with a warp yarn.

12. Hand weaving apparatus as claimed in claim 1 wherein said shedding arrangement further comprises an additional plurality of heald elements which are arranged in an alternate relation with said first mentioned movable heald elements and fixed to said bed means substantially at center positions between said first and second end positions of said movable heald elements.

* * * * *